US009290363B2

(12) United States Patent
Munuswamy et al.

(10) Patent No.: US 9,290,363 B2
(45) Date of Patent: Mar. 22, 2016

(54) TAILOR WELDED PANEL BEAM FOR CONSTRUCTION MACHINE AND METHOD OF MANUFACTURING

(75) Inventors: Arumugam Munuswamy, Hagerstown, MD (US); Donald C. Hade, Jr., Greencastle, PA (US); Uday Sankar Meka, Carpinteria, CA (US); Ashok K. Bonde, Hagerstown, MD (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 362 days.

(21) Appl. No.: 13/239,006

(22) Filed: Sep. 21, 2011

(65) Prior Publication Data

US 2013/0020274 A1 Jan. 24, 2013

Related U.S. Application Data

(60) Provisional application No. 61/510,342, filed on Jul. 21, 2011.

(51) Int. Cl.

| | |
|---|---|
| ***B66C 23/04*** | (2006.01) |
| ***B66C 23/80*** | (2006.01) |
| ***B66C 23/70*** | (2006.01) |

(52) U.S. Cl.

CPC ..... *B66C 23/80* (2013.01); *B66C 23/04* (2013.01); *B66C 23/701* (2013.01)

(58) Field of Classification Search

USPC ..... 212/347, 177, 299, 348, 350

See application file for complete search history.

(56) References Cited

U.S. PATENT DOCUMENTS

| | | | | | |
|---|---|---|---|---|---|
| 3,243,052 | A | * | 3/1966 | Grove | 212/349 |
| 3,266,051 | A | | 8/1966 | Attwood | |
| 3,481,490 | A | * | 12/1969 | Eiler | 212/350 |
| 3,620,579 | A | * | 11/1971 | Brown et al. | 384/35 |
| 3,708,937 | A | * | 1/1973 | Sterner | 52/118 |
| 3,802,136 | A | * | 4/1974 | Eiler et al. | 52/115 |

(Continued)

FOREIGN PATENT DOCUMENTS

| | | |
|---|---|---|
| CN | 1169949 A | 1/1998 |
| CN | 1723321 A | 1/2006 |

(Continued)

OTHER PUBLICATIONS

European Search Report for related European Application No. 15151928.7, dated Mar. 23, 2015 (11 pages).

(Continued)

*Primary Examiner* — Emmanuel M Marcelo
*Assistant Examiner* — Justin Stefanon
(74) *Attorney, Agent, or Firm* — Craig Buschmann; Brinks Gilson & Lione

(57) ABSTRACT

A beam for use in construction equipment is made from tailor welded panels. At least one of the panels is made from at least two pieces of material such as steel welded together with the weld running the length of the beam. The weld between pieces of steel can either be parallel to the longitudinal axis of the beam, or the pieces can be tapered and the weld will be at an angle diverging from the longitudinal axis of the beam. The two pieces of material have a different compressive strength per unit of length in a direction transverse to the longitudinal axis of the beam. In some embodiments a top panel is welded to two side panels to form two top corners of the beam and a bottom panel is welded to the two side panels to form two bottom corners of the beam.

8 Claims, 11 Drawing Sheets

(56) References Cited

U.S. PATENT DOCUMENTS

| | | | | | |
|---|---|---|---|---|---|
| 3,882,654 | A | | 5/1975 | Yancey | |
| 3,890,757 | A | * | 6/1975 | Lamer et al. | 52/695 |
| 3,985,234 | A | * | 10/1976 | Jouffray | 212/350 |
| 4,003,168 | A | * | 1/1977 | Brady | 52/118 |
| 4,016,688 | A | * | 4/1977 | Tiffin et al. | 52/118 |
| 4,112,649 | A | * | 9/1978 | Fritsch et al. | 52/843 |
| 4,168,008 | A | * | 9/1979 | Granryd | 212/350 |
| 4,171,597 | A | * | 10/1979 | Lester et al. | 52/118 |
| 4,171,598 | A | | 10/1979 | Holmes | |
| 4,214,923 | A | | 7/1980 | Price | |
| 4,216,895 | A | * | 8/1980 | Holmes | 228/178 |
| 4,257,201 | A | * | 3/1981 | Landolt et al. | 52/118 |
| 4,337,601 | A | * | 7/1982 | Vaerk et al. | 52/118 |
| 4,428,173 | A | | 1/1984 | Knell | |
| 4,459,786 | A | | 7/1984 | Pitman et al. | |
| 4,478,014 | A | | 10/1984 | Poock et al. | |
| D299,079 | S | | 12/1988 | Bernabe, Jr. | |
| D299,179 | S | | 12/1988 | Bernabe, Jr. | |
| 4,807,461 | A | | 2/1989 | Brimeyer et al. | |
| 4,807,797 | A | | 2/1989 | West | |
| 5,159,175 | A | | 10/1992 | Loeber | |
| 5,628,416 | A | * | 5/1997 | Frommelt et al. | 212/292 |
| 5,884,791 | A | * | 3/1999 | Vohdin et al. | 212/348 |
| 6,060,682 | A | | 5/2000 | Westbroek et al. | |
| 6,086,256 | A | * | 7/2000 | Paschke et al. | 384/35 |
| 6,098,824 | A | | 8/2000 | Krebs et al. | |
| 6,108,985 | A | * | 8/2000 | Paschke et al. | 52/118 |
| 6,349,489 | B1 | | 2/2002 | Sasaki et al. | |
| 6,409,459 | B1 | | 6/2002 | Ginn et al. | |
| 6,452,131 | B2 | | 9/2002 | Britnell | |
| 6,481,587 | B2 | | 11/2002 | Higgins | |
| 6,499,612 | B1 | * | 12/2002 | Harrington et al. | 212/350 |
| 6,508,019 | B1 | | 1/2003 | Sasaki et al. | |
| 6,536,652 | B2 | | 3/2003 | Sasaki et al. | |
| 6,637,111 | B2 | | 10/2003 | Sasaki et al. | |
| 6,978,907 | B2 | | 12/2005 | Paschke | |
| 7,111,745 | B2 | | 9/2006 | Nurse et al. | |
| 7,128,094 | B2 | | 10/2006 | Anderson et al. | |
| 7,165,929 | B2 | | 1/2007 | Janes et al. | |
| 7,172,082 | B2 | | 2/2007 | Irsch et al. | |
| 7,431,383 | B2 | | 10/2008 | Katayama et al. | |
| 7,578,402 | B2 | | 8/2009 | Paschke | |
| 7,670,099 | B2 | * | 3/2010 | Nakajima et al. | 414/722 |
| 7,814,730 | B2 | | 10/2010 | Grobenstieg et al. | |
| 7,878,349 | B2 | * | 2/2011 | Wimmer | 212/348 |
| 8,678,210 | B1 | * | 3/2014 | Harrington et al. | 212/347 |
| 2003/0118432 | A1 | | 6/2003 | Lee | |
| 2005/0006355 | A1 | * | 1/2005 | De Dinechin et al. | 219/121.63 |
| 2006/0021264 | A1 | * | 2/2006 | Grobenstieg et al. | 37/444 |
| 2006/0201274 | A1 | | 9/2006 | Nakajima et al. | |
| 2006/0251503 | A1 | | 11/2006 | Janes et al. | |
| 2006/0277859 | A1 | | 12/2006 | Egli et al. | |
| 2008/0292443 | A1 | | 11/2008 | Nose et al. | |
| 2009/0223093 | A1 | | 9/2009 | Willaredt et al. | |
| 2010/0107918 | A1 | | 5/2010 | Hess | |
| 2010/0276402 | A1 | | 11/2010 | Richard et al. | |

FOREIGN PATENT DOCUMENTS

| | | | | | |
|---|---|---|---|---|---|
| DE | 2317595 | | | 10/1974 | |
| DE | 29 32 337 | A1 | | 2/1981 | |
| DE | 197 11 975 | A1 | | 9/1998 | |
| DE | 199 48 830 | A1 | | 4/2001 | |
| DE | 10 2010 026 253 | | | 1/2011 | |
| EP | 583552 | A1 | * | 2/1994 | B66C 23/70 |
| EP | 0668238 | A1 | | 8/1995 | |
| EP | 1 387 012 | A2 | | 2/2004 | |
| EP | 1 640 511 | A1 | | 3/2006 | |
| FR | 2790538 | A1 | | 9/2000 | |
| GB | 2134072 | A | | 8/1984 | |
| IT | 1170972 | B | | 6/1987 | |
| JP | S51-141153 | A | | 12/1976 | |
| JP | 7-9887 | U | | 2/1995 | |
| JP | 11-021939 | | | 1/1999 | |
| JP | 11-247216 | | | 9/1999 | |
| JP | 2000-016763 | | | 1/2000 | |
| JP | 2001-115477 | | | 4/2001 | |
| JP | 2002-301582 | A | | 10/2002 | |
| JP | 2004-149268 | | | 5/2004 | |
| JP | 2005-169410 | | | 6/2005 | |
| JP | 2006-021877 | | | 1/2006 | |
| JP | 3866756 | B2 | | 10/2006 | |
| JP | 2011006837 | A | | 1/2011 | |
| WO | WO 2004/053241 | A1 | | 6/2004 | |

OTHER PUBLICATIONS

Office Action and Search Report, and English language translation thereof, in corresponding Chinese Application No. 201210255031.2, dated Apr. 24, 2015, 27 pages.

Notification of Reason for Rejection with English translation for related Japanese Application No. 2012-161078, dated Oct. 27, 2015 (13 pages).

* cited by examiner 260
262
263
265
266
267
270
275
276
277
280
285
286
287
290
295
296
297
298
299
26
27

TAILOR WELDED PANEL BEAM FOR CONSTRUCTION MACHINE AND METHOD OF MANUFACTURING

REFERENCE TO EARLIER FILED APPLICATION

The present application claims the benefit of the filing date under 35 U.S.C. §119(e) of Provisional U.S. Patent Application Ser. No. 61/510,342, filed Jul. 21, 2011, which is hereby incorporated by reference in its entirety.

BACKGROUND

The present invention relates to construction equipment, especially cranes, and the use of tailor welded panels to form beams used in the construction equipment. In one embodiment, tailor welded panels are used to make a boom section for a telescoping boom on a mobile lift crane.

Beams in construction equipment are designed to carry loads. The weight of the beam is often a significant consideration with respect to other design and usage elements of the construction equipment in which the beam is used. For example, the weights of the sections of a telescoping boom are a major factor when designing the rest of the crane. The structural stiffness of a telescoping boom is mainly to resist buckling and bending loads. The stiffness is typically maximized with a boom cross-section having minimum weight in order to increase maximum lift capacity of a crane to which the boom is attached. If the boom section weight can be reduced, the lifting capacity of the crane can usually be increased without having to increase the Gross Vehicle Weight (GVW), strength of the carrier and axle capacity. Thus, there have been many attempts to reduce the weight of the sections of the telescoping boom while maintaining the load that the boom can handle. Many such efforts have involved using high strength steel or other material to make the beam so that the beam has a high strength-to-weight ratio.

In most beams used in construction equipment, the loading on the beam is not uniform throughout all parts of the beams. For example, a beam used in a telescoping boom is often operated at an angle, which produces high bending moments in the beam sections. As a result, the top portions of the beams are in tension, and the bottom portions of the beams are in compression. Because of the way different portions of beams in construction equipment are loaded, efforts to reduce weight have also been directed to forming the beam such that it is thicker in areas where the loads are higher, and thinner material is used in areas where the loads are lower, and putting more material at points that are a greater distance from the axis of the beam to increase the buckling resistance of the beam when it is in compression. For example, in U.S. Pat. Nos. 3,620,579 and 4,016,688, a crane is made with interfitting box-like boom sections that have corners made of thicker steel than the thinner plate material between them to maximize strength and minimize weight. The boom sections in the '579 patent have an elongated corner member at each corner thereof, each corner member having generally normally disposed portions, each portion having an elongated inwardly directed linear step along the outer end thereof forming an elongated linear pocket. The boom sections also have elongated plates having edges extended generally parallel to and adjacent the corner members, with edges located in the pockets in the portions so that they overlap onto the steps. The '688 patent describes a method of making the sections of the telescoping boom by welding angle steel and plate steel members together to form a rectangular boom section. The various sections of the boom fit within each other.

Another consideration that must be taken into account when designing a beam is its cost. The cost is a function of both the material used to make it, and the steps used to form the material into the beam. Using composite materials may result in higher strength-to-weight ratios, but may have higher material costs. Formed beams for telescoping boom sections that have curved sections made by bending the metal multiple times provides higher strength than simple flat sheets, but incurs bending costs, which are high because the boom sections are very long and thus specialized computer controlled equipment with skilled labor are needed to perform the multiple bending operation.

In addition to manufacturing costs, operational costs also have to be taken into account. It might be cost advantageous to spend more money to fabricate a lighter boom in the first place because the crane will have lower operating costs over its life that outweigh a higher initial cost. Balancing manufacturing and operational cost, weight and strength considerations is difficult. Also, in some capacity ranges, initial higher beam costs may be appropriate whereas in other capacity ranges, a lower cost boom construction cost will be suitable and most cost effective over the life of the crane.

Thus there is a need for a beam design that has high strength, low weight and low cost. Also, there is a need for a beam design that allows flexibility to make changes in the design to increase strength for beams to be used in applications where higher strength is needed, while keeping the manufactured beam cost low.

BRIEF SUMMARY

With the present invention it is possible to construct a beam with a higher strength and lower weight and lower cost than many prior art beams. Also, using the concepts of the present invention, a beam designer has great flexibility to make changes in a given design relatively quickly and simply to achieve beams of similar designs but with greater strength and lower cost when needed. The beams can be used in telescoping sections of a telescoping boom, in outriggers on a crane, on chassis parts, and other applications.

A rectangular beam has been invented that has thicker cross sections at the corners of the rectangle than in the central part of the walls. However, instead of welding together four angle pieces and four side pieces, the beam is a modular design made from "Tailor Welded Panels" (TWP). In one preferred embodiment, each of the four panels making up the four side walls of a rectangular boom segment is made from three pieces of steel; one thin central section and two thicker marginal members. These are welded together longitudinally to make up one wall of the rectangular box structure. The four sides are then welded together to make the box.

In a first aspect, the invention is a beam for use in a piece of construction equipment, the beam having a longitudinal axis and comprising a top panel, a bottom panel and two side panels connected together into a body, with two top corners and two bottom corners; at least one of the panels being made from at least two pieces of material joined together, the two pieces of material having a different strength per unit of length in a direction transverse to the longitudinal axis; the top panel being welded to the two side panels to form the two top corners of the beam; and the bottom panel being welded to the two side panels to form the two bottom corners of the beam.

In a second aspect, the invention is a boom section having a longitudinal axis for use in making a telescoping boom for a crane comprising a top panel, a bottom panel and two side panels connected together into a body, with two top corners and two bottom corners; at least the bottom panel being made from at least first, second and third pieces of steel welded together with the first piece of steel in between the second and third pieces of steel, with the first piece of steel being thinner than the second and third pieces of steel; and the bottom panel being formed so as to include a curved region in the first piece of steel, the curved region running in the direction of the longitudinal axis of the boom section.

In a third aspect, the invention is a method of making a beam comprising: providing a first side panel; providing a second side panel; providing a top panel; providing a bottom panel, the bottom panel being made using a high energy-density welding process to weld at least three pieces of steel together to make the bottom panel; and using a high energy-density welding process to weld the first side panel to the top panel and the bottom panel, and to weld the second side panel to the top panel and to the bottom panel to form a four panel beam. The corner welds are preferably full penetration welds.

In a fourth aspect, the invention is a method of making a beam comprising: a) placing a first side panel adjacent a top panel so that a first edge surface of the top panel butts up against a side surface of the first side panel, and welding the first side panel and top panel together with a full penetration high energy-density weld from outside of the combined first side and top panels from a direction in the plane of the side surface of the first side panel; b) placing a second side panel adjacent the top panel so that a second edge surface of the top panel butts up against a side surface of the second side panel, and welding the second side panel and top panel together with a full penetration high energy-density weld from outside of the combined second side and top panels from a direction in the plane of the side surface of the second side panel; c) placing a bottom panel adjacent the first and second side panels, with an edge surface of each of the first and second side panels butting up against an upper surface of the bottom panel; d) welding the first side panel to the bottom panel with a full penetration high energy-density weld from outside of the combined first side panel and bottom panel from a direction in the plane of the upper surface of the bottom panel; and e) welding the second side panel to the bottom panel with a full penetration high energy-density weld from outside of the combined second side panel and bottom panel from a direction in the plane of the upper surface of the bottom panel.

In another aspect, the invention is a combination of panel members for use in making a boom section for a telescoping crane boom comprising a top panel; a bottom panel comprising at least three pieces of steel welded together, each weld running the length of a long side of the bottom panel; a first side panel comprising at least two pieces of steel welded together, the weld running the length of a long side of the first side panel; and a second side panel comprising at least two pieces of steel welded together with a butt weld between adjoining pieces, each butt weld running the length of a long side of the second side panel.

In still another aspect, the invention is a boom section having a longitudinal axis for use in making a telescoping boom for a crane comprising at least a first panel member and a second panel member, at least the second panel member comprising at least two pieces of steel welded together with a butt weld between adjoining pieces, the two pieces of steel having different compressive strength per unit of length transverse to the axis; the two panel members being welded together along a joint that runs parallel to the longitudinal axis of the section to form the boom section.

Beams built with tailor welded panels can be fabricated at a relatively low cost yet still provide high strength and low weight. Using the inventive beam design allows a crane designer to design a crane boom that will be economical for certain applications. One advantage of the preferred embodiments of the invention is that a standard process can be used to make different boom segments having different capacities by changing the thickness of the marginal parts of the TWP, or using higher yield strength steel on the marginal parts. The same basic design and manufacturing process can then easily be modified to make different boom sections for other crane models with different capacities.

One very significant feature that allows for a reduction in weight while maintaining the buckling strength is to make the bottom TWP with a formed panel in the center section, producing a bottom side wall of the boom section that has a curved region. The bend in the thin bottom plate increases the buckling resistance of that piece. (The bottom of the boom section carries compressive loads in telescoping boom cranes, while the top of the boom section carries tensile loads.) Also, the preferred embodiments of the invention provide a degree of flexibility in that different stiffnesses in the boom section can be achieved by modifying the curved region in the bottom piece. However, it is less expensive to make one part of the TWP with a curved region than it is to form an entire curved part of a boom section.

The TWP may be fabricated using a hybrid welding process, such as one that uses a laser beam for full penetration, combined with a MIG welding process. Conventional boom sections are welded together with overlapping members on the corner, and a fillet weld is made in space created by the overlap. The preferred embodiments of the invention, using the hybrid laser-MIG weld, can make a full penetration weld at the corners, and thus uses a square groove butt joint weld.

These and other advantages of the invention, as well as the invention itself, will be more easily understood in view of the attached drawings.

DETAILED DESCRIPTION OF THE DRAWINGS AND THE PRESENTLY PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The following terms used in the specification and claims have a meaning defined as follows.

The term "high energy-density welding process" refers to a welding process that includes at least one of laser beam, electron beam or plasma arc welding.

The term "hybrid welding process" refers to a welding process that combines a high energy-density welding process with conventional gas metal arc welding (GMAW) or gas tungsten arc welding (GTAW) process. The GMAW can be metal inert gas (MIG) welding or metal active gas (MAG) welding. In typical hybrid welding processes using a laser, the laser leads and the GMAW or GTAW follows.

Beams in construction equipment are generally designed for use in a specific gravitational orientation. For example, boom sections on a telescoping boom are designed with the idea that the boom will be used at an angle greater than 0° and less than 90° with respect to horizontal. Thus a portion of the boom section will always be on top, and a portion will always be on bottom, even when the boom is raised at an angle approaching 90°. The terms "top", "bottom" and "side" as used herein are thus understood to being made with respect to how a beam is intended to be used once installed in a piece of construction equipment. During fabrication of the beam, the "bottom" may at times be oriented above the "top", such as when the beam is being welded together.

The phrase "running the length of" is to be interpreted as a direction rather than a distance. For instance, "a weld running the length of a long side of the bottom panel" means that the direction of the weld is in the direction of the long side of the bottom panel. The phrase does not imply that the weld is as long as the entire length of the long side of the bottom panel, although the weld could be that long. Also, the phrase does not imply that the weld is a straight line, but only that it travels generally in the direction indicated.

Figure 1:
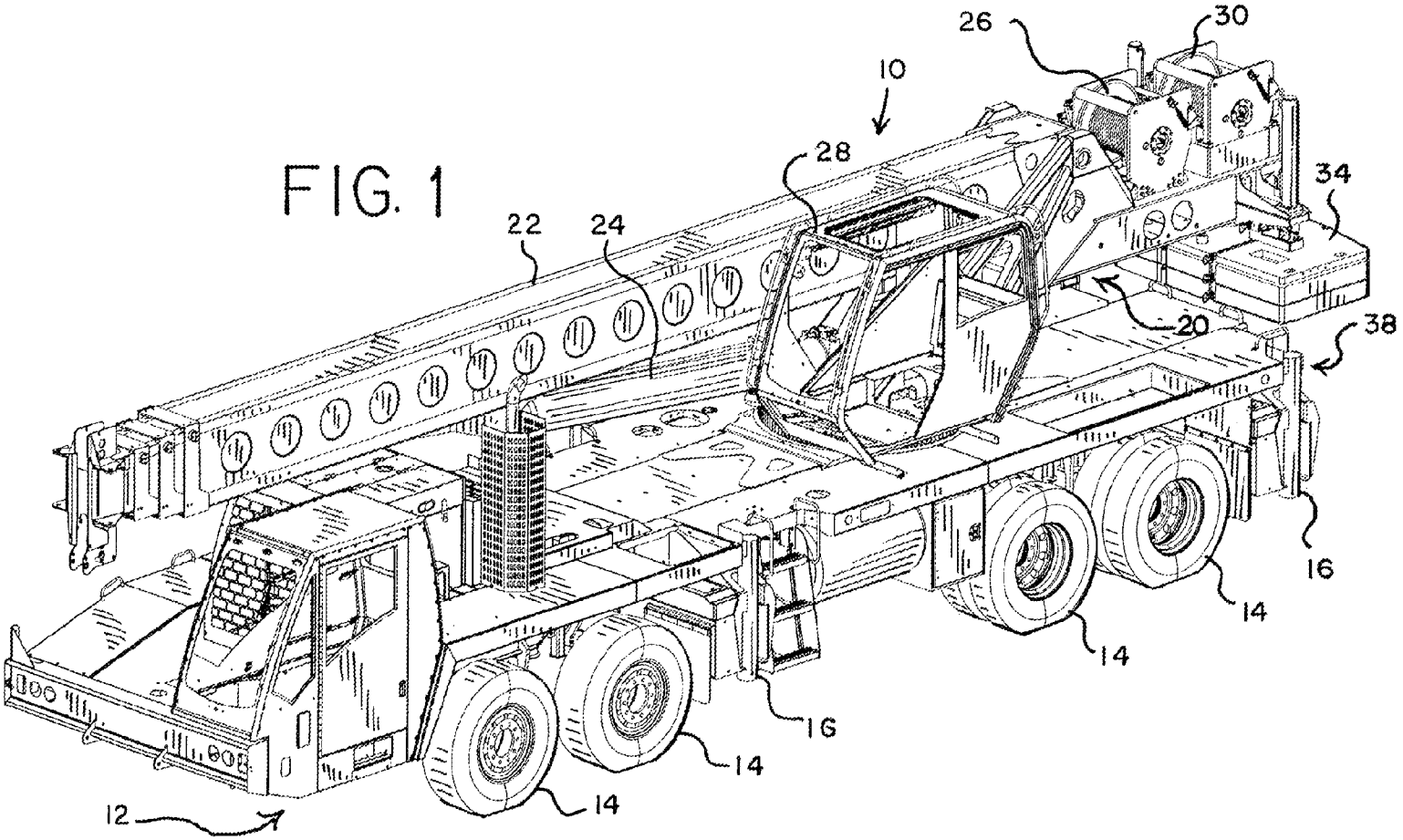
FIG. 1 is a perspective view of a mobile lift crane with a telescoping boom made from beams using the present invention.
Figure 4:
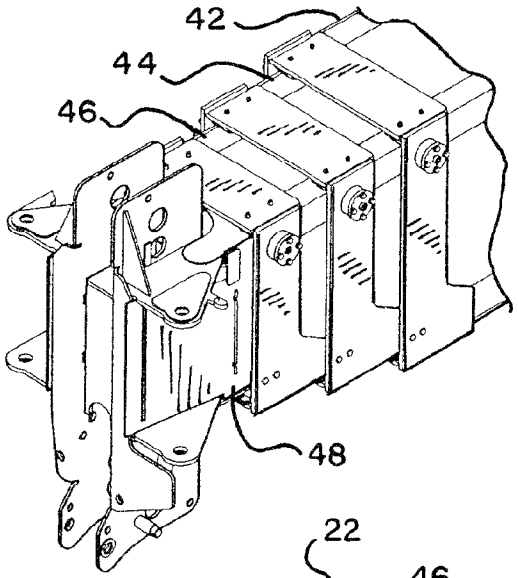
FIG. 4 is an enlarged perspective view of the nose of the boom of FIG. 2.

While the invention will have applicability to many types of construction equipment, it will be described in connection with a mobile lift crane 10, shown in a transport configuration in FIG. 1. (Several elements of the crane 10, such as the boom top sheaves, load hoist lines, operator cab components, etc. are not included for sake of clarity.) The mobile lift crane 10 includes lower works, also referred to as a carrier 12, with moveable ground engaging members in the form of tires 14. Of course other types of moveable ground engaging members, such as crawlers, could be used on the crane 10. The crane 10 also includes stationary ground engaging members in the forms of jacks 16 on outrigger beams as part of outrigger assembly 38, discussed in more detail below.

A turntable 20 is mounted to the carrier 12 such that the turntable can swing about a vertical axis with respect to the ground engaging members 14 and 16. The turntable supports a boom 22 pivotally mounted on the turntable. A hydraulic cylinder 24 is used as a boom lift mechanism (sometimes referred to as a boom hoist mechanism) that can be used to change the angle of the boom relative to the horizontal axis during crane operation. The crane 10 also includes a counterweight unit 34. The counterweight may be in the form of multiple stacks of individual counterweight members on a support member.

During normal crane operation, a load hoist line (not shown) is trained over a pulley, usually by being reeved through a set of boom top sheaves on the boom 22, and will support a hook block (not shown). At the other end, the load hoist line is wound on a load hoist drum 26 connected to the turntable. The turntable 20 includes other elements commonly found on a mobile lift crane, such as an operator's cab 28. A second hoist drum 30 for a whip line may be included. The other details of crane 10 are not significant to an understanding of the invention and can be the same as on a conventional telescoping boom crane.

Figure 3:
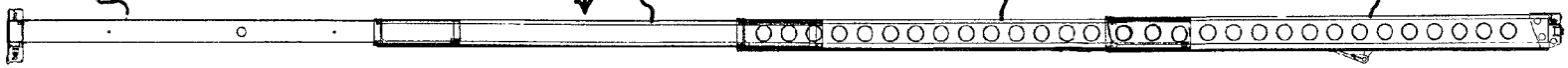
FIG. 3 is a side elevational view of the telescoping boom of the crane of FIG. 1 in an extended position.
Figure 2:
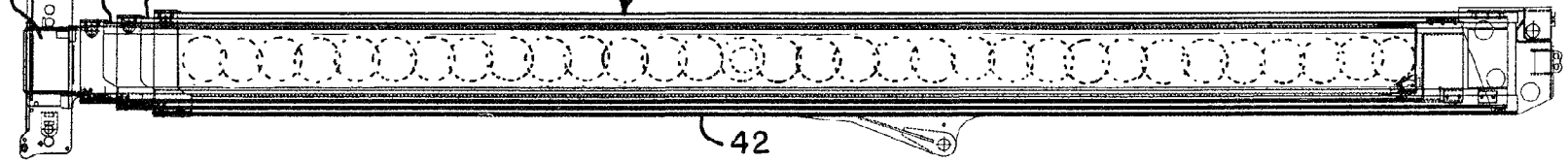
FIG. 2 is a side elevational view of the telescoping boom of the crane of FIG. 1 in a retracted position.

The boom 22 is constructed by connecting multiple boom sections together in a telescoping manner. As best seen in FIGS. 2 and 3, the boom 22 is made from four sections: base section 42, a first telescoping section 44 that fits within the base section 42, a second telescoping section 46 that fits within the first telescoping section 44, and a third telescoping section 48 that fits within the second telescoping section 46. Of course the invention can be used to make booms with fewer or greater numbers of sections, such as two, three, five, six and even seven section telescoping booms. As seen in FIG.

3, the third telescoping section 48 extends out of the top end of the second telescoping section 46 and is designed to be fitted with a boom top.

The manner of attaching the boom sections to one another and telescoping the boom sections 42, 44, 46 and 48 with respect to one another can be the same as in existing telescoping boom cranes. The crane 10 differs from conventional telescoping boom cranes primarily in the construction of the hollow beams that serve as boom sections 42, 44, 46 and 48.

As best seen in FIGS. 5-8, an individual boom section 44 is made from a beam having a longitudinal axis 43 and a generally rectangular transverse cross-section comprising a top panel 50, a bottom panel 60 and two side panels 70 and 80 connected together into a body, with two top corners 57 and 58 and two bottom corners 76 and 86. At least one of the panels, and preferably at least three of the panels, and in the case of beam 44, all four of the panels, are made from at least two pieces of material welded together. These panels are referred to as tailor welded panels (TWP), because the pieces welded together to form the panel may be "tailored" with respect to dimension, material grade, formed shape, etc. to the specific part of the beam for which the panel is constructed, and also tailored to the application to which the beam will be used. In this embodiment, the welds between the individual pieces in each panel run parallel to the longitudinal axis of the beam, but this is not always the case, as discussed below with respect to FIGS. 20-29.

Figures 5, 6, 7:
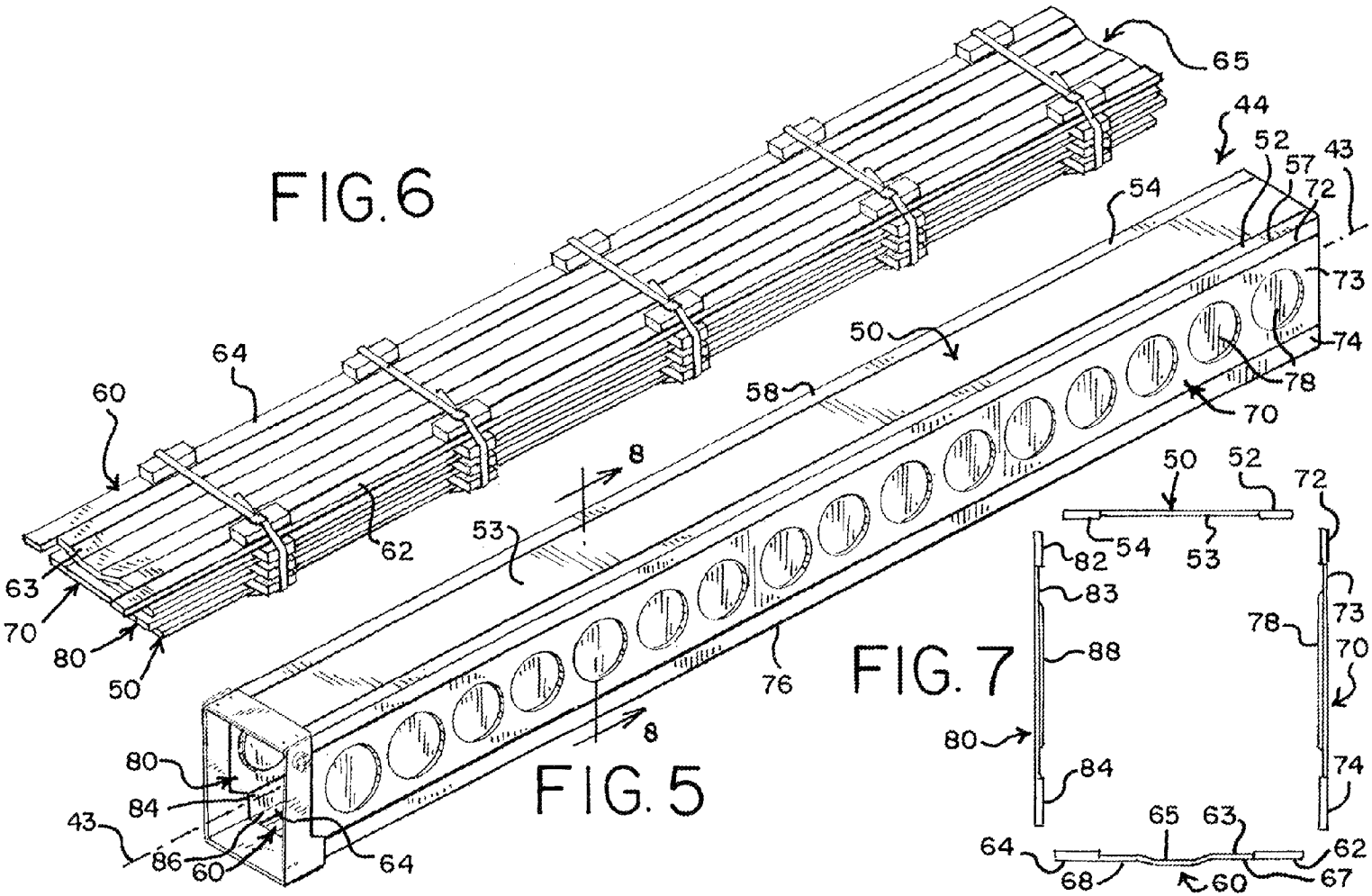
FIG. 5 is a perspective view of one beam used as a section of the boom of FIG. 2.
FIG. 6 is a perspective view of a combination of tailor welded panels used to construct the beam of FIG. 5, packaged for shipment as a bundle.
FIG. 7 is an exploded end view of the panels of FIG. 6 prior to being welded to form the beam of FIG. 5.
Figure 8:
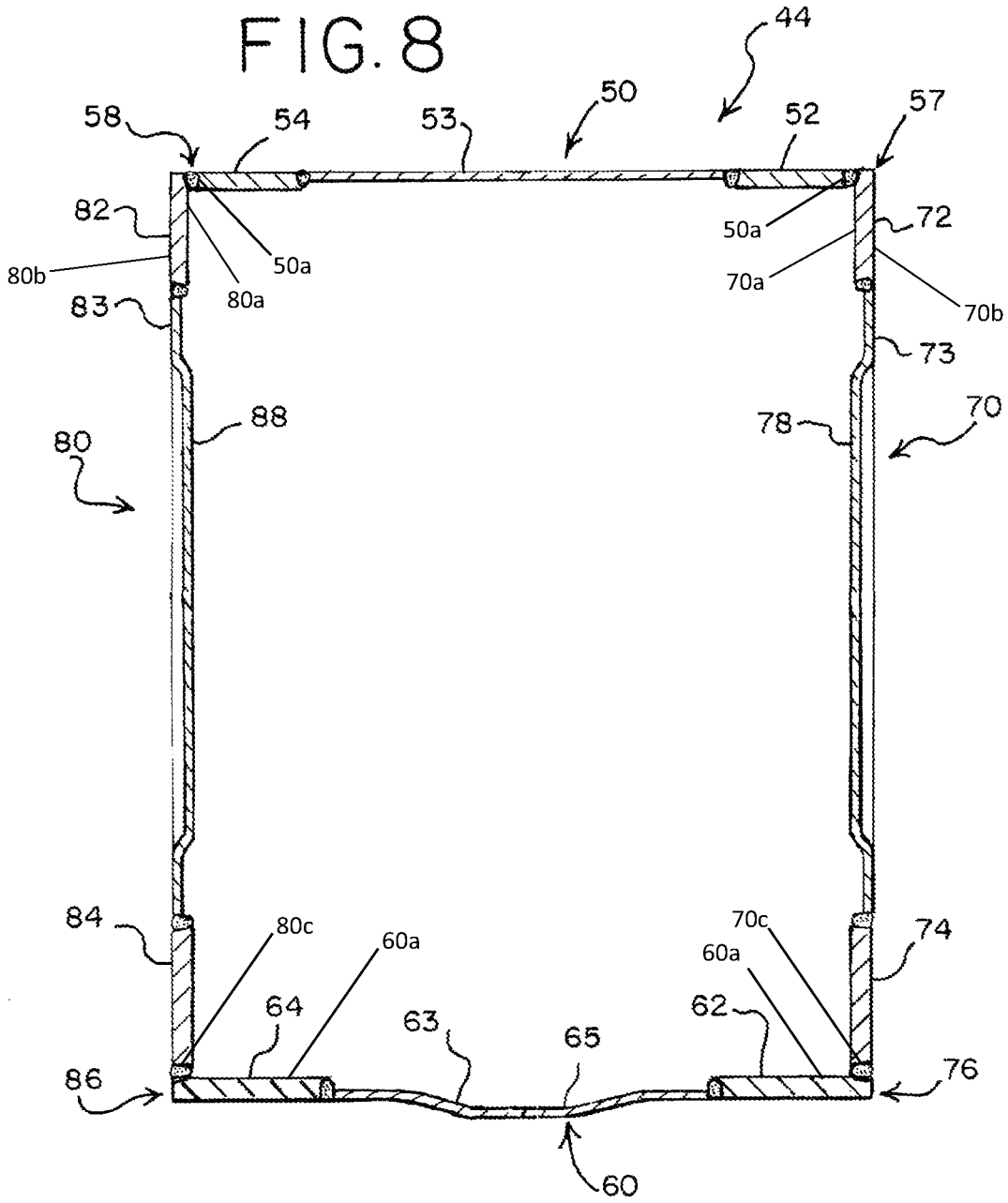
FIG. 8 is a cross sectional view taken along the line 8-8 of FIG. 5.

In the TWP, the different portions of the panels usually have a different strength per unit of length in a direction transverse to the longitudinal axis 43. In the beam 44, each of the panels is made from pieces of steel, and specifically at least three pieces of steel, with at least two of the pieces of steel having different thicknesses than one another. The three pieces of steel form two sides and a mid-portion on each panel, with the steel used on the sides of each of the panels being thicker than the steel used in the mid-portion of the same panel, as seen in FIGS. 7 and 8, so that the center piece in each set of three has a smaller thickness than the thicknesses of the outer pieces. Alternatively, each of the panels could be made from at least three pieces of steel, with at least two of the pieces of steel having different yield strengths than one another, with a higher yield strength steel being used on the side portions of the panels. Of course the side portions could have a different thickness than the center portion and also be made of a steel with a different yield strength than that of the steel used for the mid-portion.

Thus, as can be seen from the above description, the preferred boom sections have a longitudinal axis and at least a first panel member and a second panel member, at least the second panel member comprising at least two pieces of steel welded together, with the weld running parallel to the longitudinal axis of the boom section. The two pieces of steel have a different compressive strength per unit of length transverse to the axis 43. The two panel members are welded together along a joint that runs parallel to the longitudinal axis of the section to form the boom section.

In the case of beam 44, the top panel 50 is made from first, second and third pieces of steel welded together with the first piece of steel 53 in between the second and third pieces of steel 52 and 54, each weld running parallel to the longitudinal axis 43 of the beam 44. Likewise, bottom panel 60 is made from a first piece of steel 63 in between second and third pieces of steel 62 and 64. Side panels 70 and 80 are made respectively from pieces 73, 72, 74 and 83, 82 and 84.

When the panels 50, 60, 70 and 80 are welded together, each of the corners comprise a fabricated, reinforced corner. In the depicted embodiment, corner 57 is made from the side portion 52 of panel 50 and the side portion 72 of panel 70. Likewise, corner 58 is made from the side portion 54 of panel 50 and the side portion 82 of panel 80. Bottom corner 76 is made from the side portion 62 of panel 60 and the side portion 74 of panel 70; and bottom corner 86 is made from the side portion 64 of panel 60 and the side portion 84 of panel 80. The panels are welded together with a square groove butt joint made without any edge preparation or beveling. The weld between panels is a full penetration weld made by welding from a single side of the panel.

In other words, and as illustrated in FIG.8, each top corner 57, 58 is made from an edge surface 50*a* of the top panel 50 butting up against an inside surface 70*a*, 80*a* of one of the side panels 70, 80. A plane defined by the inside surface 70*a*, 80*a* of the side panel 70, 80 is parallel to an outside surface 70*b*, 80*b* of the side panel 70, 80. The welds occur at the two top corners 57, 58 where the edge surface 50*a* of the top panel 50 butts up against the inside surface 70*a*, 80*a* of a side panel 70, 80. Likewise, each bottom corner 76, 86 is made from an edge surface 70*c*, 80*c* of one of the side panel 70, 80 butting up against an upper surface 60a of the bottom panel 60. The welds occur at the two bottom corners 76, 86 where the edge surface 70c, 80c of each side panel 70, 80 butts up against the upper surface 60a of the bottom panel 60.

In the panel 50, the two outer pieces of steel 52 and 54 have the same thickness as each other. The outer pieces of steel in panel 60 are the same way. However, the outer pieces on a given panel could have different thicknesses from one another. For example, the lower outer pieces 74 and 84 of panels 70 and 80 could be thicker than the upper side pieces 72 and 82. Also, the thicknesses of outer pieces do not need to be the same between panels. In other words, side portion 64 does not need to be the same thickness as side portion 54 or 84. Preferably, when the same yield strength steel is used for all pieces in a panel, the two adjoining outer pieces, such as 62 and 64, have a thickness that is at least 1.5 times the thickness of the center piece 63. More preferably the two adjoining outer pieces have a thickness that is at least twice the thickness of the center piece.

Panel 60 has three pieces of steel with a center piece 63 having a first compressive strength per unit of length in a direction transverse to the longitudinal axis 43, and the two adjoining outer pieces 62 and 64 each have a compressive strength per unit of length in a direction transverse to the longitudinal axis greater than the first compressive strength. The compressive strength per unit of length is determined by multiplying the thickness of the steel and the compressive yield strength of the steel. For example, a piece of steel having a compressive yield strength of 80 ksi (80,000 pounds per square inch) that is ½ inch thick will have a compressive strength per unit of length of 40,000 pounds per inch. Thus the compressive strength per unit of length of the two outer pieces 62 and 64 can be higher than the compressive strength per unit of length of center piece 63 either by 1) using thicker steel in the outer pieces 62 and 64 than the thickness of the center piece 63, with the steel of all three pieces having the same compressive yield strength; or 2) using the same thickness of steel for each of pieces 62, 64 and 63 but using a higher compressive yield strength steel in the two outer pieces 62 and 64 than is used for the center piece 63. While other yield strength steels can be used, the three pieces of steel in the bottom panel preferable all have a compressive yield strength of between about 100 ksi and about 120 ksi.

Panel 60 is different than the other panels in that it is formed so as to include a curved region in the first piece of steel 63, the curved region 65 running in the direction of longitudinal axis 43 of the beam 44, thereby forming a rib.

Preferably the curved region 65 includes a plurality of bends in the steel running parallel to the long side of the bottom panel 60. As best seen in FIGS. 7 and 8, the second and third pieces of steel 62 and 64 each provide a relatively flat region adjacent the bottom corners 76 and 86. Also, the first piece of steel 63 itself includes portions 67 and 68 outside of the curved region 65 that are relatively flat and have outer surfaces that are on the same plane as the outer surfaces of pieces 62 and 64.

Figure 16:
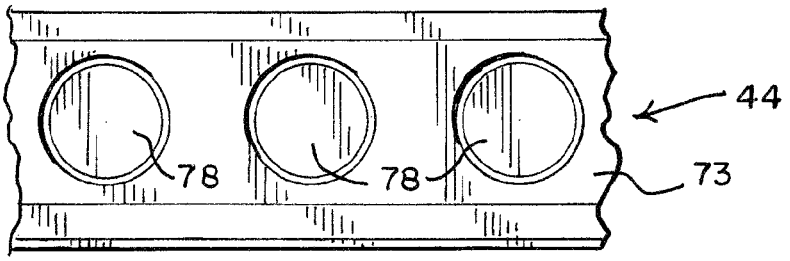
FIG. 16 is a partial side elevational view of the beam of FIG. 5.
Figure 17:
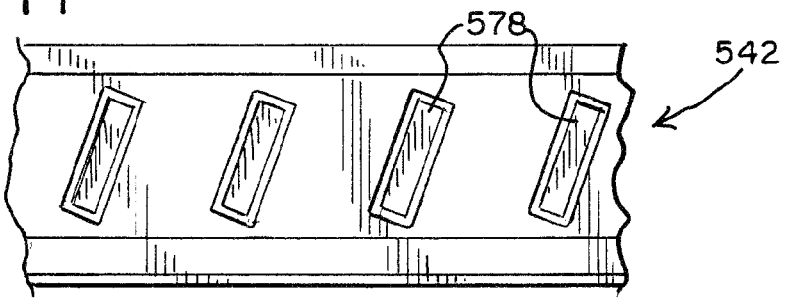
FIG. 17 is a partial side elevational view of fifth alternate design for a beam used to make a telescoping boom.
Figure 18:
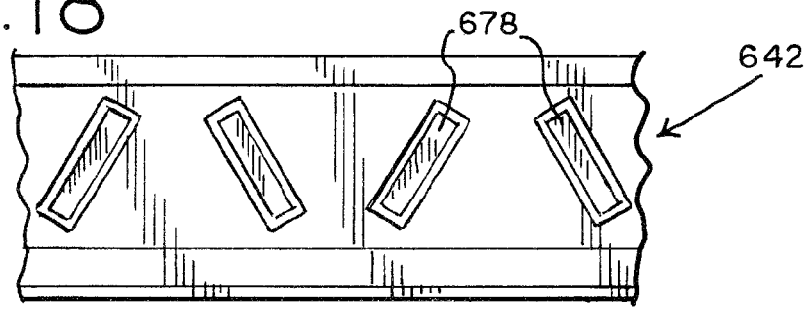
FIG. 18 is a partial side elevational view of sixth alternate design for a beam used to make a telescoping boom.
Figure 19:
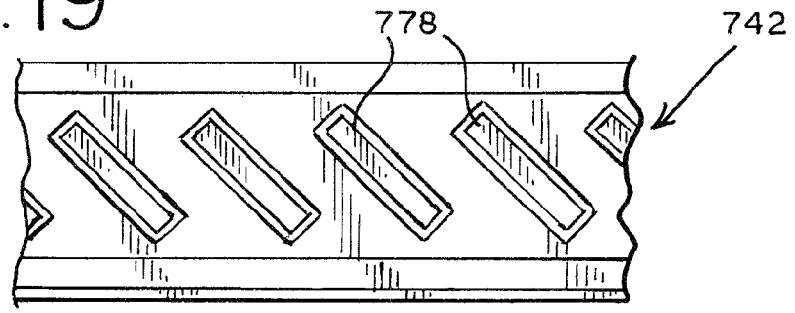
FIG. 19 is a partial side elevational view of seventh alternate design for a beam used to make a telescoping boom.

Whereas the top panel 50 is generally flat and the bottom panel 60 includes curved region 65, the side panels 70 and 80 are generally flat but each includes a plurality of embossings 78 and 88. The steel making up the center portions 73 and 83 of the side panels 70 and 80 is stamped with a plurality of embossings to increase the stiffness of the side panels. The embossed stampings 78 and 88 on beam 44 are circular in shape, as seen in FIG. 16. However, the embossing could have other shapes, such as parallel slanted rectangles 578 and 778 as shown on beams 542 and 742 in FIGS. 17 and 19 respectively, and slanted rectangles 678 at alternating angles to each other, as shown on beam 642 in FIG. 18. Also, not all boom sections need embossing. As seen in FIG. 3, telescoping boom sections 46 and 48 are made without embossing on the side panels. Further, in some crane embodiments, a standard 4-plate boom design can be used for the third telescoping section 48.

The beam 44 is constructed by first producing the individual panels 50, 60, 70 and 80, and then welding the panels together. Preferably the bottom panel is made using a high energy-density welding process to weld at least three pieces of steel together. Preferably a high energy-density welding process is also used to weld at least two pieces of steel (in this case three pieces of steel) together to make the first side panel 70, and at least two (preferably three) additional pieces of steel to make the second side panel 80. Preferably a high energy-density welding process is also used to weld at least three additional pieces of steel together to make the top panel 50. The weld between the first and second pieces of steel, and the weld between the first and third pieces of steel in each panel preferably comprises a butt weld. The pieces of steel are welded together with a square groove butt joint made without any edge preparation or beveling. The welds between pieces of steel are preferably full penetration welds made by welding from a single side of the panel.

After the individual panels are produced, preferably a high energy-density welding process is used to weld the first side panel 70 to the top panel 50 and the bottom panel 60, and to weld the second side panel 80 to the top panel 50 and to the bottom panel 60 to form a four panel beam. The preferred high energy-density welding process uses both a laser and GMAW, with the GMAW preferably being MIG welding, although MAG welding could also be used with the laser welding.

The placement of the panel members next to one another to form the corners, and the type of weld used to form the corners, are preferably as shown in FIG. 8. The first side panel 70 is placed adjacent the top panel 50 so that a first edge surface of the top panel 50 butts up against a side surface of the first side panel 70. The first side panel 70 and top panel 50 are then welded together with a full penetration high energy-density weld from outside of the combined first side and top panels from a direction in the plane of the inside surface of the first side panel 70. Next the second side panel 80 is placed adjacent the top panel 50 so that a second edge surface of the top panel 50 butts up against a side surface of the second side panel 80. The second side panel 80 and top panel 50 are then welded together with a full penetration high energy-density weld from outside of the combined second side and top panels from a direction in the plane of the inside surface of the second side panel. Lastly the bottom panel 60 is placed adjacent the first and second side panels 70 and 80, with an edge surface of each of the first and second side panels butting up against an upper surface of the bottom panel 60. The first side panel 70 is then welded to the bottom panel 60 with a full penetration high energy-density weld from outside of the combined first side panel and bottom panel from a direction in the plane of the upper surface of the bottom panel; and the second side panel 80 is then welded to the bottom panel 60 with a full penetration high energy-density weld from outside of the combined second side panel and bottom panel from a direction in the plane of the upper surface of the bottom panel 60. The top and bottom corner joints are thus located vertically and horizontally respectively for facilitating loading conditions on the beam when it is used as a crane boom section. The weld joints with face and root as shown in FIG. 8 are strategically oriented such that the top welds can better handle shear and bending loads, whereas the bottom welds can better handle compressive loads. While this orientation is preferable, the welds can also be oriented in different ways for ease of fabrication. The root of a weld is typically sensitive to process imperfections compared to the face of the weld, so it is preferable, when a beam is subject to bending forces in which the top panel is in tension and the bottom panel is in compression, to orient the weld so that the root of the weld for the top panel has less tensile loads compared to the face of the weld. When the beam 44 is extended from base 42, the highest loads on the individual welds will be those in the socket area, where the beams overlap. As seen in FIG. 8, the root of each of the welds in the corners 57 and 58 are oriented to put the root of the weld in the place where it will have less tensile loads than if the weld were oriented differently. While the weld between the second side panel 80 and the bottom panel 60 is described above as being made last, that weld can be made before the weld between the first side panel 70 and the bottom panel 60.

In order to obtain full penetration welds, the thickness of the first and second side panels 70 and 80 at the weld to the bottom panel 60 is preferably about 10 mm or less, and the thickness of the bottom panel 60 at the welds to the first and second side panels 70 and 80 is preferably about 12 mm or less. While other dimensions can be used, one exemplary design for beam 44 uses 1) a top panel 50 with a center plate 53 thickness of 4 mm, and each of the side portions 52 and 54 having a width of 76.2 mm and a thickness of 10 mm; 2) a bottom panel 60 with a center plate 63 thickness of 4 mm, and each of the side portions 62 and 64 having a width of 101.6 mm and a thickness of 12.7-mm; and 3) side plates 70 and 80 having a thickness 5 mm in their center portions 73 and 83. The side portions 72, 74, 84 and 84 are all 10 mm thick. Side portions 72 and 82 have a width of 76.2 mm, while side portions 74 and 84 are 101.6 mm wide. The embossment depth in this example is equal to the thickness of the center portions 73 and 83.

Since the beam 44 has a generally rectangular transverse cross-section, the first side panel 70 is placed adjacent the top panel 50 at an angle of 90°, and the second side panel 80 is also placed adjacent the top panel 50 at an angle of 90°, for welding in the above process. Likewise the bottom panel 60 is placed adjacent the first and second side panels 70 and 80 at an angle of 90° to each of the side panels for the above welding process.

The separate panel members may be fabricated at one fabrication facility and then shipped together in a combination bundle to be fabricated into a beam at another fabrication facility. Such a bundle of TWP is shown in FIG. 6 and is referred to as a panel kit. The panel kit in FIG. 6 includes panel members for use in making a boom section for a telescoping crane boom. The combination includes a top panel 50; a bottom panel 60, a first side panel 70 and a second side panel 80 as described above. Preferably the welds in the bottom panel 60 and the welds in each of the side panels 70 and 80 each comprise a butt weld between adjoining pieces of steel. Preferably by the time the panels are bundled together as a kit, the first and second side panels 70 and 80 already include the embossings 78 and 88 for those boom sections that include embossings on the side panels. When the beam 44 is constructed from the panels, fittings, connectors and end reinforcements are also welded to the beam, as in conventional telescoping boom sections. However, because of the use of thicker outer portions 52, 54, 62, 64, 72, 74, 82 and 84 on the panels, there is no need to add doublers as are conventional used in rectangular telescoping boom sections.

Figure 9:
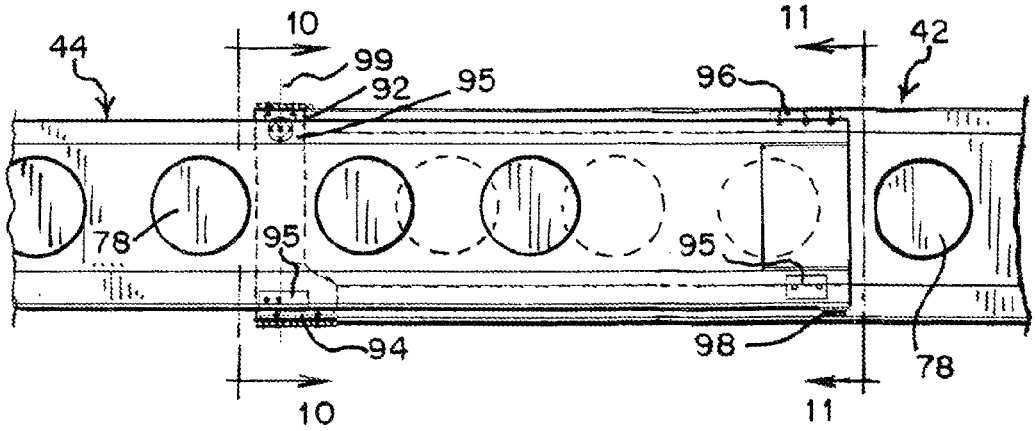
FIG. 9 is an enlarged partial side elevational view of the boom of FIG. 3.
Figure 10:
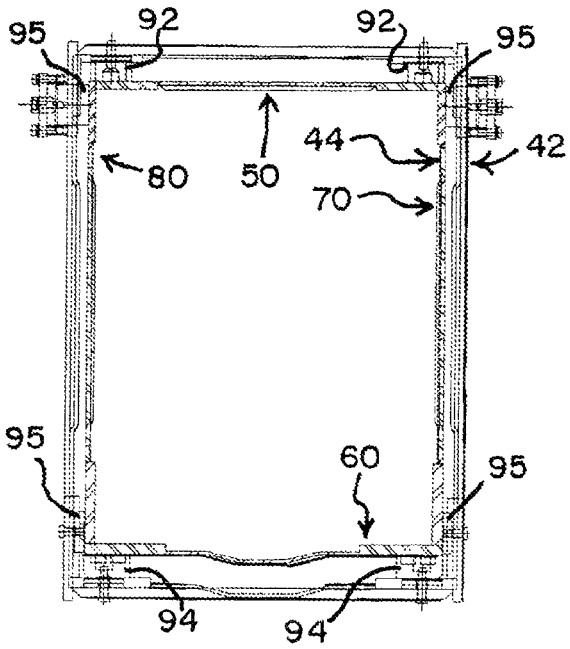
FIG. 10 is a cross-sectional view taken along line 10-10 of FIG. 9.
Figure 11:
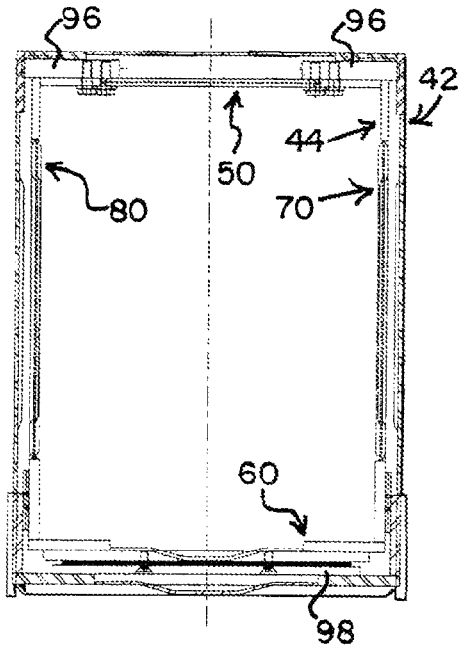
FIG. 11 is a cross-sectional view taken along line 11-11 of FIG. 9.

Once the beam 44 is constructed, it can be used to make the telescoping boom 22. As noted above, the telescoping boom 22 comprises first, second and third telescoping sections and a base section, with one section slideably fitting inside of another section. While the beam 44 is described as the first telescoping section for the boom 22, any one of, and preferable all of the sections 42, 44, 46 and 48, can be made with TWP. As seen in FIGS. 9-11, beam 42 is constructed with TWP just like those used in beam 44, but with larger dimensions so that beam 44 can fit inside of beam 42.

As with conventional boom sections, the first boom section 42 includes two top front wear pads 92 connected to the top panel 50, two bottom front wear pads 94 connected to the bottom panel 60, and a side front wear pad 95 connected to each side panel 70 and 80, as best seen in FIGS. 9-11. Of course greater numbers of individual wear pads could be used. Preferably the base section 42 also includes rear upper wear pads 96 attached to upper plate 50, and the first telescoping section 44 includes a lower rear wear pad 98 that is attached across the bottom of its bottom plate. As seen in FIG. 11, the top wear pads 96 are placed so that they extend past the width of the beam 44 so that they also provide side wear pads. One of the benefits of the use of a TWP for the plates making up the base section 42 and first telescoping beam 44 is that thicker pieces 52, 54, 62 and 64 in the top and bottom panels 50, 60 provide rails for contact of wear pads between boom sections. It is preferable for wear pads 92, 94 and 95 to be positioned such that a common transverse plane (represented by line 99 in FIG. 9) intersects at the longitudinal centerline of those wear pads. It is also preferable that the common transverse plane intersecting wear pads 92, 94 and 95 is evenly spaced between adjacent embossings 78, 88 on each of the side plates 70 and 80 of beam 44 when the beam is at its fully extended design position, as seen in FIG. 9. It has been found that the placement of the embossing as described above improves the buckling resistance on the side panels.

Figure 12:
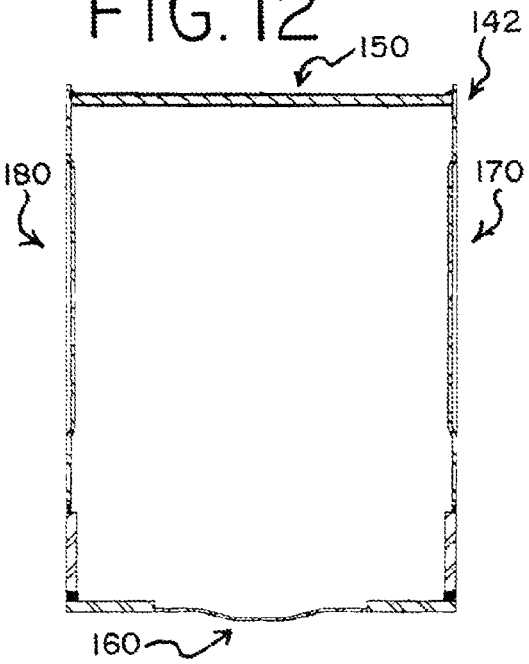
FIG. 12 is a cross-sectional view of a first alternate design for a beam used to make a telescoping boom.

While the beam 44 has four TWP, in other embodiments at least the bottom panel and the two side panels are each made from at least two pieces of steel, and the top panel could be made from a single piece of steel, as shown in FIG. 12. The beam 142 has a bottom panel 160 made from at least three pieces of steel forming two sides and a mid-portion on the panel, with the steel used on the sides of the bottom panel being thicker than the steel used in the mid-portion of the bottom panel. However, top panel 150 is just a single piece of steel, and the two side panels 170 and 180 are made from two pieces of steel.

Figure 13:
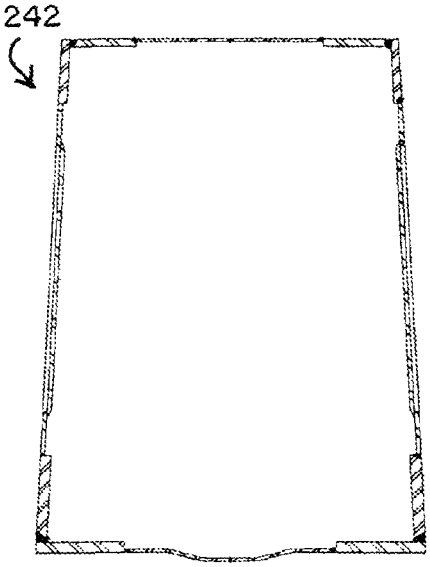
FIG. 13 is a cross-sectional view of a second alternate design for a beam used to make a telescoping boom.

Besides being rectangular, the beams of the present invention can have other transverse cross-sectional shapes. For example, in other embodiments, the beam 242 may have a generally trapezoidal transverse cross-section, as seen in FIG. 13.

Figure 14:
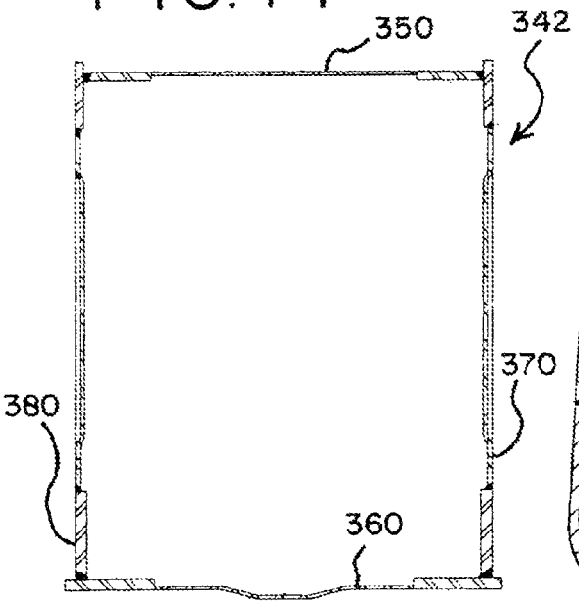
FIG. 14 is a cross-sectional view of a third alternate design for a beam used to make a telescoping boom.

FIG. 14 shows another alternative design for a beam 342 made with TWP. Each of the panels 350, 360, 370 and 380 are made from three pieces of steel, just like panels 50, 60, 70 and 80. However, the beam 342 is constructed using different joints in the corners. Instead of the corners being flush, the bottom panel 360 extends out past the side panels 370 and 380. Also, the top panel 350 is welded in between the side panels 370 and 380, which extend upwardly beyond the top panel. In this embodiment the panels may be welded together with conventional welding methods due to manufacturing flexibility with respect to cost and resource availability.

Figure 15:
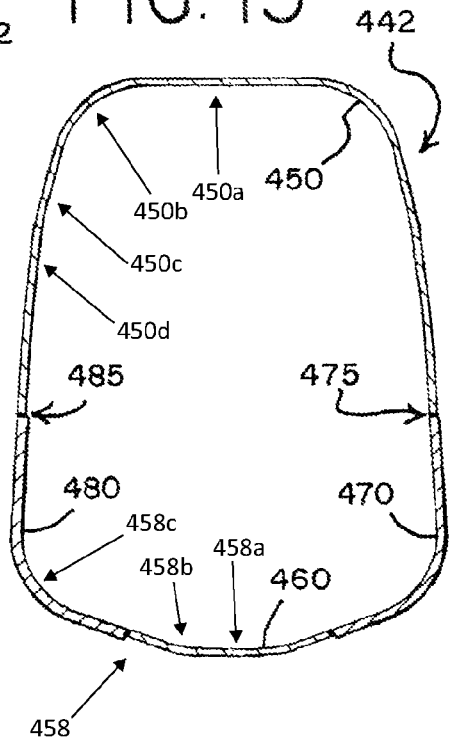
FIG. 15 is a cross-sectional view of a fourth alternate design for a beam used to make a telescoping boom.

Another alternative beam configuration that can be used to make a telescoping boom is to have a beam 442 with cross-sectional sections of varying curvature, as shown in FIG. 15. In this embodiment the beam is made from at least a first panel member and a second panel member. A first panel member 450 is formed into a curved shape and provides a top shell for the boom section. The first panel member 450, when viewed in cross-section, includes at least two sections of different curvature, such as sections 450*a*, 450*b*, 450*c*, 450*d* as representative examples. A second panel member 458 comprises at least two, and in this case three pieces of steel 460, 470 and 480, welded together with a butt weld between adjoining pieces, each butt weld running parallel to the longitudinal axis of the boom section. The three pieces that form the second panel member 458 of steel 460, 470 and 480 are formed into a curved shape providing a bottom shell of the boom section. The second panel member 458, when viewed in cross-section, includes at least two sections of different curvature, such as sections 458*a*, 458*b*, 458*c* as representative examples. The three pieces of steel 460, 470 and 480 comprise a center piece 460 having a first thickness, and the two adjoining outer pieces 470 and 480 each having a thickness greater than the first thickness. Thus at least two of the pieces of steel have a different compressive strength per unit of length transverse to the axis of the beam. The pieces 470 and 480 are welded with full penetration butt welds to panel member 450 respectively at welds 475 and 485. Thus, the two panel members are welded together along a joint that runs parallel to the longitudinal axis of the section to form the boom section. The three pieces of steel 460, 470 and 480 could be welded together in a flat panel that is thereafter bent to form the shape seen in FIG. 15, or the three individual pieces of steel 460, 470 and 480 could be bent first and then welded together.

Another alternate boom is made of beams 212 and 262, seen in FIGS. 20-29. The primary difference between the beams 212 and 262, compared to beam 44, is that on at least some of the panels, the welds between pieces of steel making up the individual panels are not parallel to the longitudinal axis of the beam. Rather, the welds are at a small angle with respect to the longitudinal axis, so that the thicker pieces of steel are wider at the base portion of the beam and get narrower at the head portion of the beam. Of course the thinner piece of steel in between the thicker pieces of steel gets wider going from the base to the top of the beam.

FIGS. 20-23 show a beam 212 that can be used as a first telescopic section of a boom. Like beam 44, beam 212 has a longitudinal axis 213 and a generally rectangular transverse cross-section. The beam 212 has a top panel 220, two side panels 230 and 240 and a bottom panel 250 connected together into a body, with two top corners 223 and 224 and two bottom corners 253 and 254. All four of the panels are made from three pieces of steel welded together. These panels are also referred to as tailor welded panels (TWP), because the pieces welded together to form the panel are "tailored" with respect to dimension, material grade, formed shape, etc. to the specific part of the beam for which the panel is constructed.

Figures 20, 21, 22, 23:
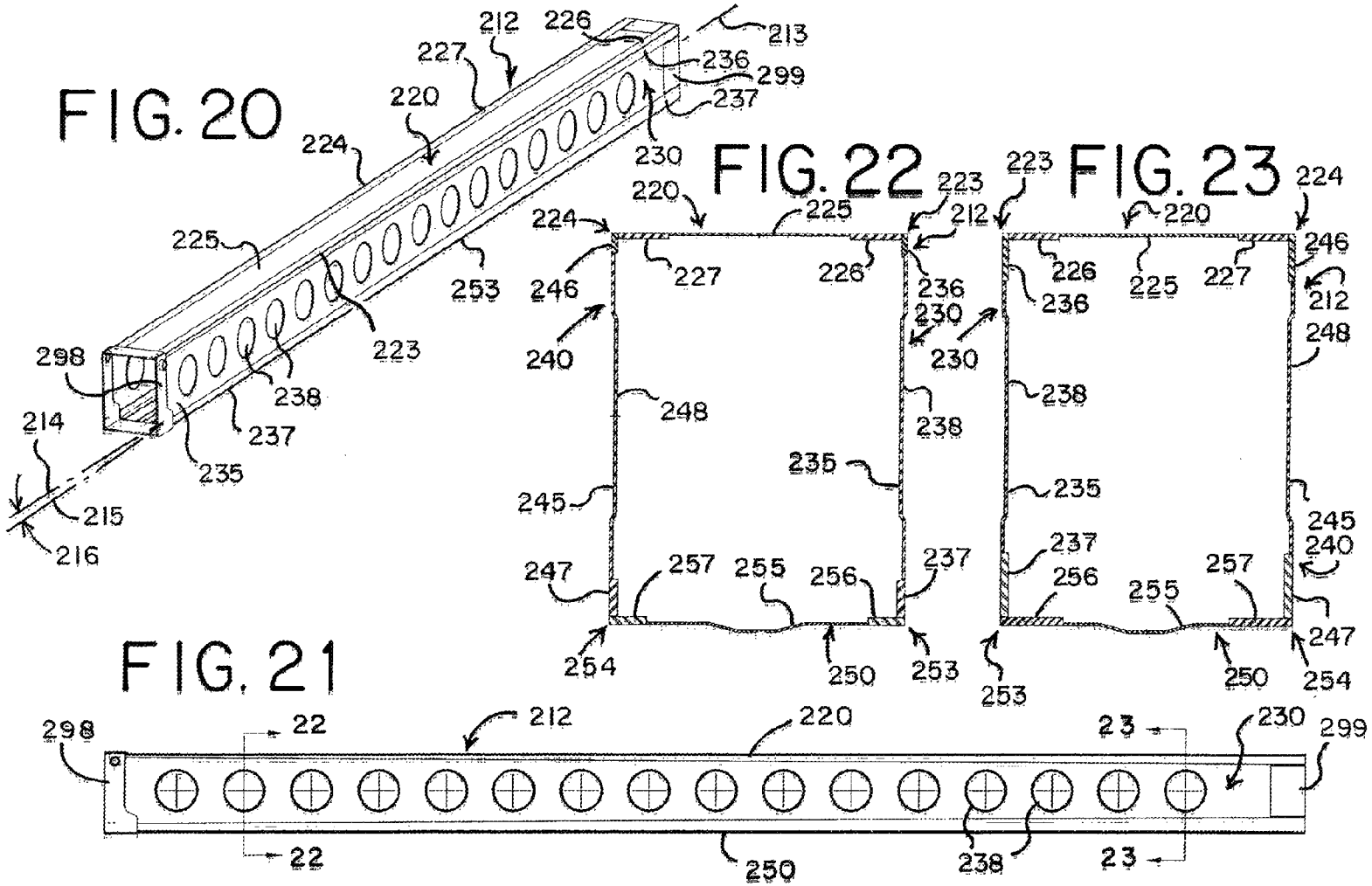
FIG. 20 is a perspective view of a beam used as a first section for an alternate design of the boom of FIG. 2.
FIG. 21 is a side elevational view of the beam of FIG. 20.
FIG. 22 is a cross sectional view taken along the line 22-22 of FIG. 21.
FIG. 23 is a cross-sectional view taken along line 23-23 of FIG. 21.
Figures 24, 25, 26, 27:
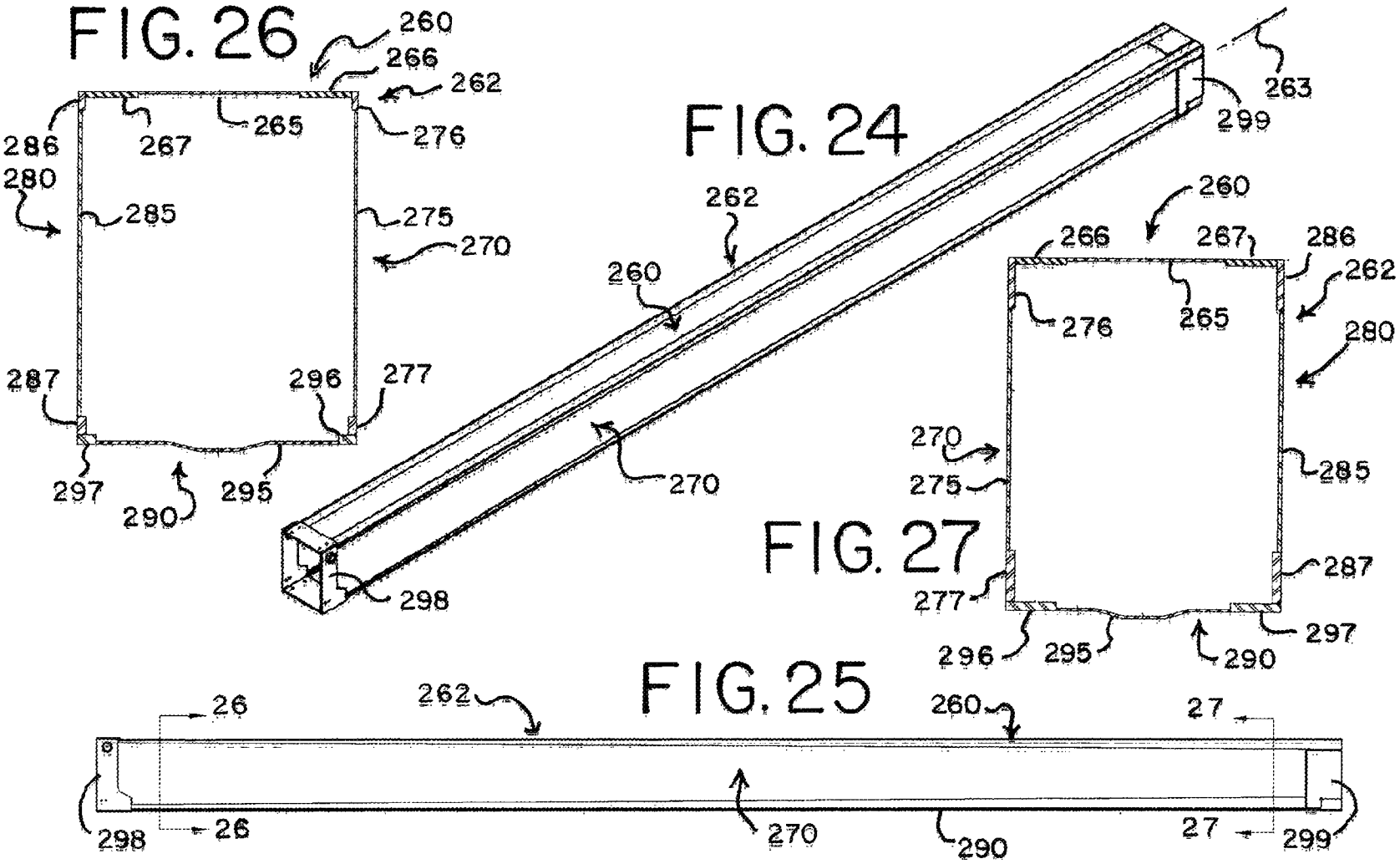
FIG. 24 is a perspective view of a beam used as a second section along with the beam of FIG. 20 to make the alternate design of the boom of FIG. 2.
FIG. 25 is a side elevational view of the beam of FIG. 24.
FIG. 26 is a cross-sectional view taken along the line 26-26 of FIG. 25.
FIG. 27 is a cross-sectional view taken along line 27-27 of FIG. 25.

In beam 212 the side panel 230 is made from first, second and third pieces of steel welded together with the first piece of steel 235 in between the second and third pieces of steel 236 and 237. However, the welds between adjoining pieces run at an angle diverging from a line parallel to the longitudinal axis 213 of the beam. The angle will be between 0.1° and 2°, and preferably between 0.3° and 0.5°, depending on the length and width of the panel 230. For a panel 30 feet long and 20 inches wide, used as a side panel in a beam for a telescoping boom, the angle will preferably be about 0.33°. In FIG. 20, line 215 follows the direction of the weld between pieces of steel 235 and 237. Another line 214 has been drawn that is parallel to the longitudinal axis 213 to help show this angle. Angle 216 is thus the angle between the weld and a line intersecting the weld and parallel to the longitudinal axis 213 of the beam 212.

Bottom panel 250 is made from a first piece of steel 255 in between second and third pieces of steel 256 and 257. Side panel 240 is made from pieces 245, 246 and 247. In each of these panels, the thicker pieces of steel on the sides of the panels is wider at the base portion of the beam, as best seen in FIG. 23, than it is in the top end of the beam, seen in FIG. 22. Pieces 236, 237, 246, 247, 256 and 257 are each wider in FIG. 23 than they are in FIG. 22. In this embodiment, the top panel 220 is made from pieces of steel 225, 226 and 227 that are welded together with welds running parallel to the longitudinal axis of the beam 212, so the pieces 225, 226 and 227 do not change widths over the length of the beam. Preferable the top panel 220 is made this way because the thicker side pieces 226 and 227 are needed to be wide throughout their entire length to engage wear pads. With three of the panels in the beam 212 having optimized tapered side pieces (also sometimes referred to as tapered rails) in their panels, a savings in weight over the rectangle parallel rails is achieved.

In the panels 220, 230, 240 and 250, the two outer pieces of steel have the same thickness as each other, and have a compressive strength per unit of length in a direction transverse to the longitudinal axis 213 that is greater than the compressive strength of the center piece. However, as with beam 44, the outer pieces on a given panel could have different thicknesses from one another.

Panel 250, like panel 60, is different than the other panels in that it is formed so as to include a curved region in the first piece of steel 255, the curved region running in the direction of longitudinal axis 213 of the beam 212, thereby forming a rib. Preferably the curved region includes a plurality of bends in the steel running parallel to the long side of the bottom panel 250.

Like their counterparts in beam 44, the side panels 230 and 240 are generally flat but each includes a plurality of embossings 238 and 248. The embossed stampings 238 and 248 are circular in shape, but could be other shapes. Also, not all boom sections need embossing.

The beam 212 is constructed by first producing the individual panels 220, 230, 240 and 250, and then welding the panels together. A high energy-density welding process can be used, and can be controlled so as to travel along a path that is not parallel to the longitudinal axis of the beam to create the angled welds between the pieces in the individual panels when welding the three pieces of steel together. The weld between the first and second pieces of steel, and the weld between the first and third pieces of steel in each panel preferably comprises a butt weld. The pieces of steel are welded together with a square groove butt joint made without any edge preparation or beveling. The welds between pieces of steel are preferably full penetration welds made by welding from a single side of the panel.

After the individual panels are produced, preferably a high energy-density welding process is used to weld the first side panel 230 to the top panel 220 and the bottom panel 250, and to weld the second side panel 240 to the top panel 220 and to the bottom panel 250 to form a four panel beam. When the panels 220, 230, 240 and 250 are welded together, each of the corners comprise a fabricated, reinforced corner, just as with beam 44. The panels are welded together with a square groove butt joint made without any edge preparation or beveling. The weld between panels is a full penetration weld made by welding from a single side of the panel. After the panels are welded together a profile cut collar 298 is welded to the panels at the head of the beam 212. Also, plates 299 are added to form a collar at the foot of the beam 212.

Beam 262, shown in FIGS. 24-27, is like beam 212 except that the side panels are made without embossing. The three pieces of steel 275, 276 and 277 making up side panel 270 are welded together with a weld that is at a small angle with respect to the longitudinal axis 263 of the beam 262. The three pieces of steel 275, 276 and 277 are tapered so that the thicker, outside pieces 276 and 277 are wider at the base of the beam and narrower at the top of the beam, while the center piece 275 is narrower at the base of the beam and wider at the top of the beam 262. Likewise three pieces of steel 285, 286 and 287 making up side panel 280 are tapered in the same way, as are the three pieces of steel 295, 296 and 297 making up the bottom panel 290. This is best seen by comparing the cross-sectional views in FIG. 27 (near the base of the beam 262) with the cross-sectional view in FIG. 26 (near the top of the beam). As with beam 212, the welds between the pieces of steel 265, 266 and 267 making up the top panel 260 of beam 262 are parallel to the longitudinal axis of the beam 262.

Figure 28:
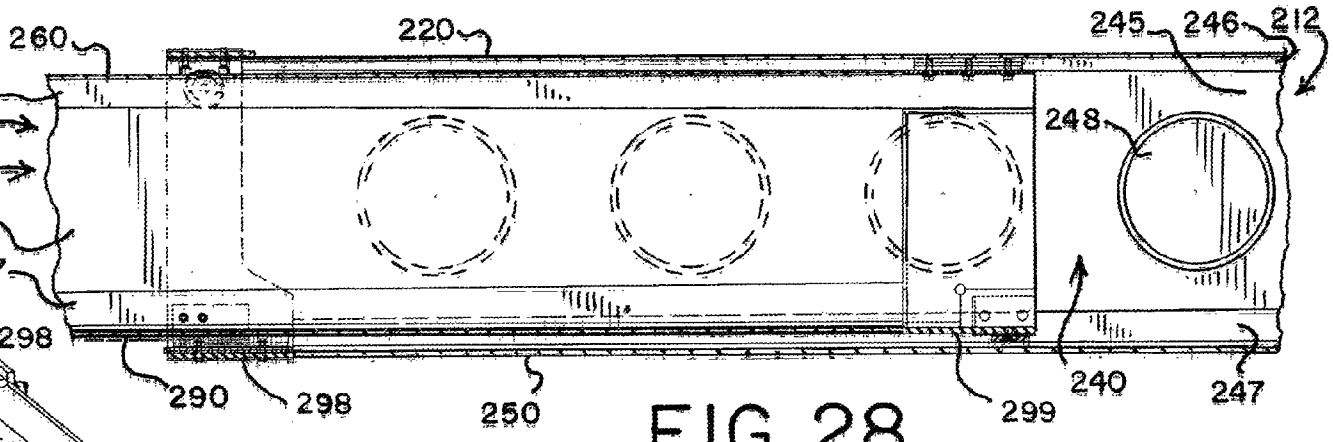
FIG. 28 is an enlarged partial side elevational view like FIG. 9 but of the overlap in sections when the beams of FIGS. 20 and 24 are assembled to make the alternate design boom.
Figure 29:
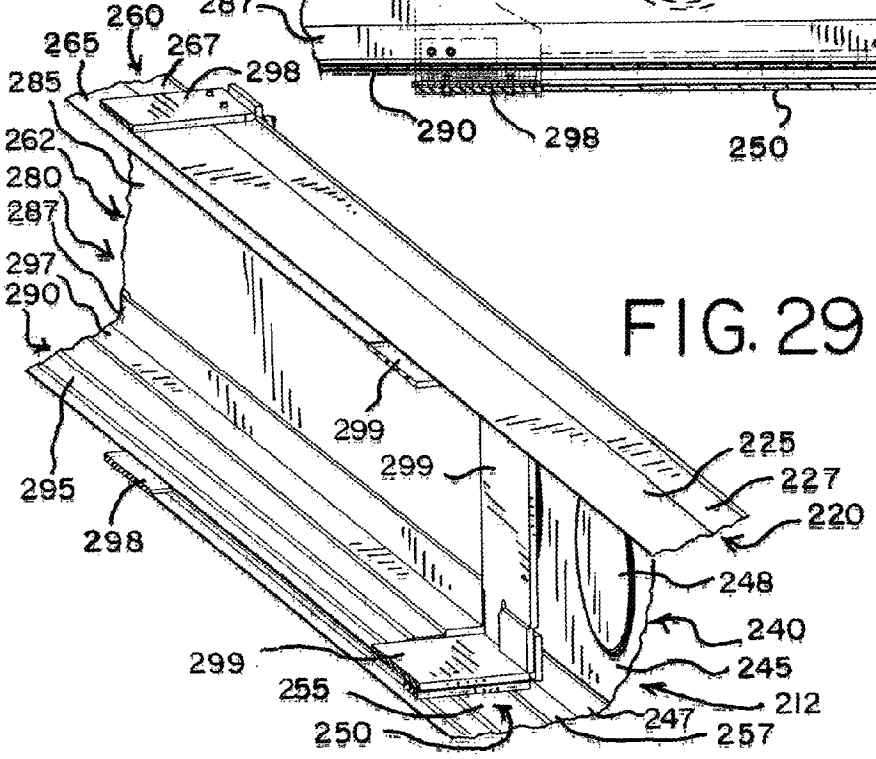
FIG. 29 is a partial internal perspective view of overlapping sections of FIG. 28.

The overlap of beams 212 and 262 when the beams are assembled to make a telescoping boom are seen in FIGS. 28 and 29. The wear pads are arranged on the beams 212 and 262 just as they are on beams 42 and 44, seen in FIG. 9. FIG. 29 also shows the reinforcing members 299 that are added to the tailor welded panels to form the very ends of the beams when the beams 212 and 262 are used in making a telescoping boom. These reinforcing members 299 are conventional and very similar to reinforcing members used on beams made of single-member panels.

Rather than having straight line welds between the pieces of steel making up the panels, the weld lines could follow a shallow curved pattern or a long stepped pattern, or a combinations of weld lines that are at different slopes.

The beams of the preferred embodiments of the invention are particularly well suited to make booms for truck mounted cranes, all terrain cranes and rough terrain cranes. The rectangular beams are particularly well suited for cranes that have a capacity of between about 30 and 70 U.S. tons. For cranes above this range, a boom made from sections like that shown in FIG. 15, while more expensive to form because of the bending required, may provide cost advantages over the life of the crane. Also, using aspects of the invention with boom sections that have multiple curved regions enables modular design flexibility.

Figure 30:
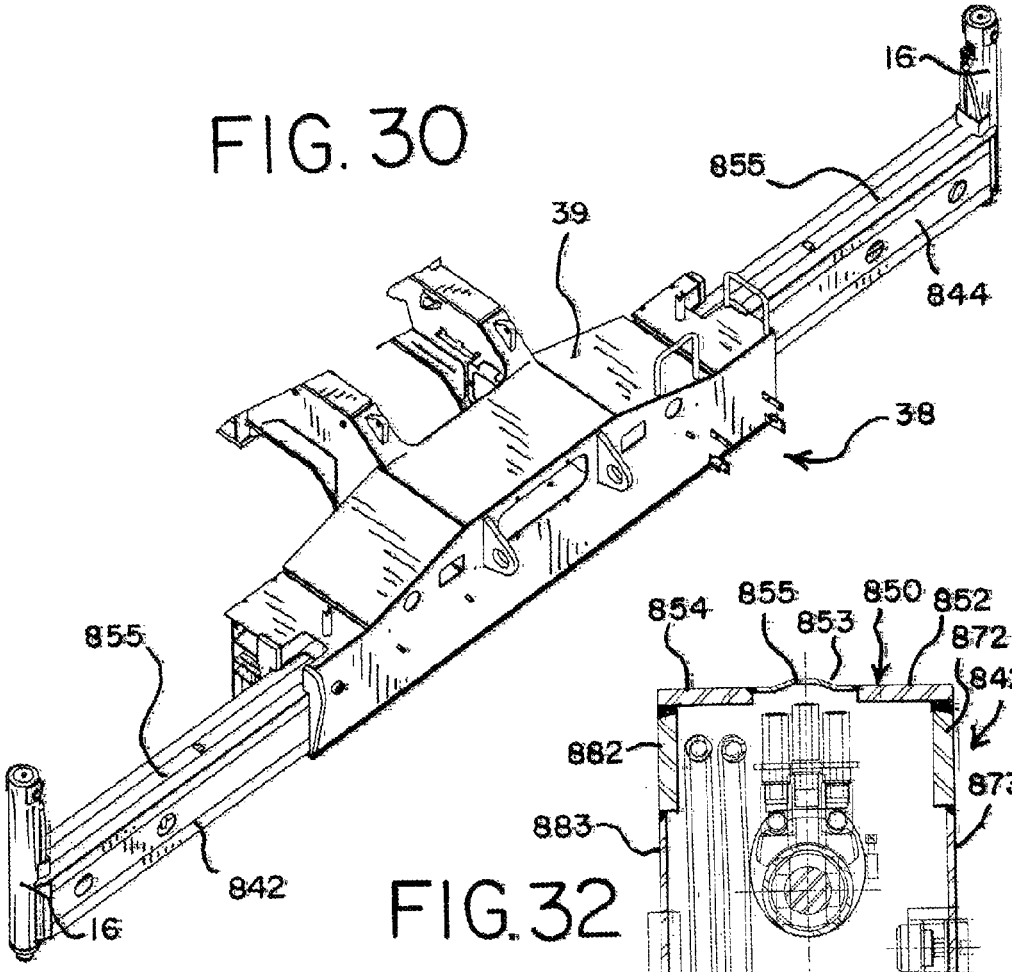
FIG. 30 is a perspective view of an outrigger assembly used on the crane of FIG. 1.
Figure 32:
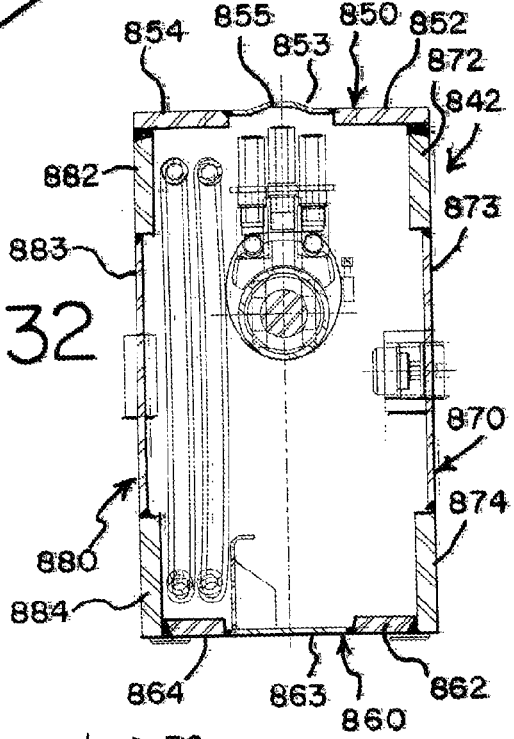
FIG. 32 is a cross sectional view taken along the line 32-32 of FIG. 31.
Figure 31:
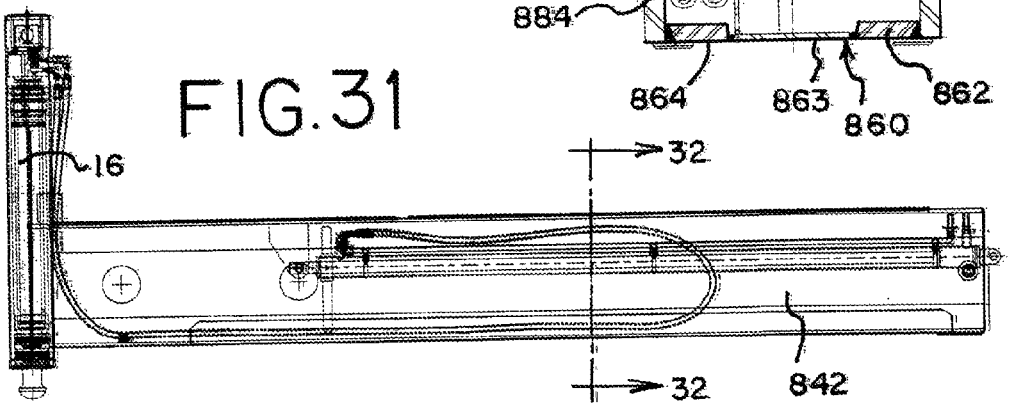
FIG. 31 is a side elevational view of one beam and jack of the outrigger assembly of FIG. 30.

In addition to having advantages when used as a telescoping section of a telescoping boom, the beams of the preferred embodiments of the invention have advantages when used as other components on construction equipment, such as beams in a chassis for a vehicle, such as a carrier 20 for a mobile crane. A beam of the preferred embodiments of the invention can also be advantageously used as a side extension beam of an outrigger assembly, such as outrigger assembly 38. FIGS. 30-32 show this usage in more detail.

As seen in FIG. 30, the outrigger assembly 38 includes a central frame 39 supporting two outrigger beams 842 and 844. The beams 842 and 844 are mounted in the central frame 39 so that they can be extended from a transport configuration (seen in FIG. 1) to an extended position (seen in FIG. 30). The manner in which the beams 842 and 844 are mounted in the central frame 39 and the manner in which they extend can be the same as in current conventional outrigger assemblies. Each of the beams 842 and 844 is equipped with a jacking cylinder 16, as is conventional. The hydraulic lines used to power the jacking cylinder 16 and return hydraulic fluid can be seen in FIG. 31, and in cross section in FIG. 32.

The beams 842 and 844 are constructed using TWP, best seen in FIG. 32. Both beams 842 and 844 will have a similar construction, so only beam 842 is discussed in detail. The beam 842 has a generally rectangular transverse cross section, just like beam 44, and is made with four panels 850, 860, 870 and 880, each made with three pieces of steel. Top panel 850 has a thin piece of steel 853 welded between thick pieces of steel 852 and 854, and bottom panel 860 has a thin piece of steel 863 welded between thick pieces of steel 862 and 864. Side panels 870 and 880 have thin pieces of steel 873 and 883 welded between thick pieces of steel 872, 874 and 882, 884 respectively. Unlike beam 44, in beam 842 the top panel includes a central curved region 855 and the bottom panel 860 is relatively flat. The curved region 855 in the piece of steel 853 runs in the direction of longitudinal axis of the beam 842. Preferably the curved region 855 includes a plurality of bends in the steel running parallel to the long side of the top panel 850. The reason that the curved region is included in the top panel 850 is that the loading in beam 842, when the beams 842 and 844 are extended and the weight of the crane 10 and any load picked up by the crane is bearing on jacks 16, puts the top panel 850 in compression and the bottom panel 860 in tension. The curved region 855 provides greater resistance to buckling under compression than would a flat panel.

The preferred embodiments of the present invention provide numerous benefits. Thicker material at the reinforced corners of the rectangular boom and thinner material elsewhere gives an optimized weight of the boom by eliminating unnecessary material where it is not effectively used. For example, the above noted exemplary design of FIG. 5 can produce a boom that is very similar in strength to the boom used on a Manitowoc model NBT50 crane but is 20% less in weight. The result is an increased load chart capacity in the stability (tipping) region due to a lighter boom. The preferred boom section of the present invention has a reduced cost compared to other rectangular shape boom sections of comparable capacity, and a lower manufactured cost than a MEGAFORM style boom.

The TWP design integrates parts and eliminates reinforcements and stiffeners needing to be added during manufacturing. The boom section can be designed to use 100 ksi material, which will reduces dependency on higher grade materials that are less readily available and may have to be imported. The TWP concept allows the thicknesses, material grades and formed shapes to be varied as required by load chart capacity.

The concept of the present invention, with modular design of individual panels, enables engineering scale-up and scale-down depending upon crane capacity. The design can be scaled-down or scaled-up for lower and higher capacity cranes up to certain limits. This is due to the ability to control thicknesses and material grades of reinforced corners, bottom/top/side plates independently, to meet load chart capacity requirements.

With the preferred embodiments of the invention, front-end technology development enables critical concept and architecture decision making before other crane design steps are taken.

The boom section can be constructed into any shape used for telescoping boom applications for performance-cost-benefit, and is not limited to the shapes shown in FIGS. 8 and 12-15. Since it uses a formed shape in the region 65 to resist buckling load, the shape can be changed depending upon the buckling load without increasing the weight. The overall design is also flexible, allowing a change of the material grade and thickness and formed shapes of the individual pieces used in TWP.

The thick portions on the sides of the TWPs form reinforced corners to accommodate wear pads. This construction allows the use of conventional wear pad for transferring loads. The thicker sections of the plates take all of the concentrated pad load from the adjoining boom section. The preferred arrangements of wear pads and embossments locations allows for uniform transfer of the load.

The TWP design concept enables manufacturing flexibility. The panels can be manufactured as a kit and shipped, or complete boom sections can be constructed at a supplier's site, depending on manufacturing capacity and capability at the time. This results in leverage for the supply chain for boom cost reduction that will reduce the product cost. There is design flexibility to change the material grade, thickness and manufacturing process (bending, roll forming, laser welding) of individual panels. Each panel can be designed and manufactured in a different way than other panels in the boom section.

Another flexibility is that the process allows the use of manufacturing processes such as laser-hybrid welding or any conventional automatic MIG welding. TWP with laser-hybrid welding provides high welding speed and low heat input, which reduces distortion and side plate waviness. The welds are narrow and have deep penetration, improving weld quality. Because the welds are made using full penetration single sided laser-hybrid welding, the distortion and heat affected zone (HAZ) area are reduced. This will help maintain the boom structural dimensional stability, and the steel to retain required mechanical properties.

Using the preferred embodiments of the invention allows a boom designer to stretch the structural limits of the conventional flat plate rectangle shape with reduced weight to increase lifting capacity. If stiffening is required, it can be incorporate into the TWP instead of adding stiffeners after manufacturing the rectangle box shape. This eliminates doubler requirements at top and side plates, which in turn eliminates secondary operations like flame cutting, welding etc., and eliminates distortion of the structure due to high heat inputs during doubler welding.

The curved region 65 can be roll formed. The roll formed bottom plate increases buckling resistance of the bottom plate 60 compared to flat plate.

It should be understood that various changes and modifications to the presently preferred embodiments described herein will be apparent to those skilled in the art. The invention is applicable to other types of construction equipment besides telescoping boom cranes, and could be used on a single stage boom for a crane, and in an aerial work platform. Not all, or even a majority, of panels in a given beam need to be made from tailor welded panels. In a telescoping boom crane, not all of the telescoping sections need to be made with a tailor welded panel. While tailor welded panels made from steel have been disclosed, the tailor welded panels could be made from a composite material. Such a panel would preferably have two outer pieces of steel (such as pieces 52 and 54) and a composite material built up between the pieces of steel (forming the equivalent of piece 53) with the joints between the composite material and the steel the length of the beam. The outer pieces of steel could then still be welded to other panels with a high-density welding process to form the reinforced corners. Such changes and modifications can be made without departing from the spirit and scope of the present invention and without diminishing its intended advantages. It is therefore intended that such changes and modifications be covered by the appended claims.

The invention claimed is:

1. A method of making a beam comprising:

a) providing a first side panel;

b) providing a second side panel;

c) providing a top panel;

d) providing a bottom panel, the bottom panel being made using a high energy-density welding process to weld at least three pieces of steel together to make the bottom panel; and e) using a high energy-density welding process to weld the first side panel to the top panel and the bottom panel to form a top corner and a bottom corners of the beam, and to weld the second side panel to the top panel and to the bottom panel to form another top corner and another bottom corner of the beam to form a four panel beam, with each top corner being made from an edge surface of the top panel butting up against an inside surface of one of the first side panel and the second side panel, wherein a plane defined by said inside surface of one of the first side panel and the second side panel is parallel to an outside surface of one of the first side panel and the second side panel, with the welds occurring at the top corner where the edge surface of the top panel butts up against the inside surface of one of the first side panel and second side panel, and with each bottom corner being made from an edge surface of one of the first side panel and the second side panel butting up against an upper surface of the bottom panel, with the welds occurring at the bottom corners where the edge surface of one of the first side panel and the second side panel butts up against the upper surface of the bottom panel.

2. The method of claim 1 wherein a high energy-density welding process is used to weld at least two pieces of steel together to make the first side panel, and a high energy-density welding process is used to weld at least two additional pieces of steel together to make the second side panel.

3. The method of claim 1 wherein the high energy-density welding process uses both a laser and GMAW welding.

4. The method of claim 3 wherein the GMAW welding is selected from the group comprising MIG welding and MAG welding.

5. The method of claim 1 wherein in the at least three pieces of steel in step d) are welded together using butt welds.

6. A method of making a beam comprising:

a) placing a first side panel adjacent a top panel so that a first edge surface of the top panel butts up against an inside surface of the first side panel to form a top corner, wherein a plane defined by the inside surface of the first side panel is parallel to an outside surface of the first side panel, and welding the first side panel and top panel together at the top corner where the edge surface of the top panel butts up against the inside surface of the first side panel with a full penetration high energy-density weld from outside of the combined first side and top panels from a direction in a plane defined by said inside surface of the first side panel;

b) placing a second side panel adjacent the top panel so that a second edge surface of the top panel butts up against an inside surface of the second side panel to form another top corner, wherein a plane defined by the inside surface of the second side panel is parallel to an outside surface of the second side panel, and welding the second side panel and top panel together at the another top corner where the edge surface of the top panel butts up against the inside surface of a second side panel with a full penetration high energy-density weld from outside of the combined second side and top panels from a direction in a plane defined by said inside surface of the second side panel;

c) placing a bottom panel adjacent the first and second side panels, with an edge surface of each of the first and second side panels butting up against an upper surface of the bottom panel to form a bottom corner and another bottom corner;

d) welding the first side panel to the bottom panel at the bottom corner where the edge surface of the first side panel butts up against the upper surface of the bottom panel with a full penetration high energy-density weld from outside of the combined first side panel and bottom panel from a direction in a plane defined by said upper surface of the bottom panel; and e) welding the second side panel to the bottom panel at the another bottom corner where the edge surface of the second side panel butts up against the upper surface of the bottom panel with a full penetration high energy-density weld from outside of the combined second side panel and bottom panel from a direction in the plane defined by said upper surface of the bottom panel.

7. The method of claim 6 wherein the beam has a generally rectangular transverse cross-section and the first side panel is placed adjacent a top panel at an angle of 90° to each other for welding in step a), the second side panel is placed adjacent the top panel at an angle of 90° to each other for welding in step b), and the bottom panel is placed adjacent the first and second side panels at an angle of 90° to each of the side panels in steps c).

8. The method of claim 6 wherein the weld between the second side panel and the bottom panel is made before the weld between the first side panel and the bottom panel.

* * * * *